US008272377B2

(12) United States Patent
Tsakiris

(10) Patent No.: US 8,272,377 B2
(45) Date of Patent: Sep. 25, 2012

(54) EXTENDABLE HOOD FOR MICROWAVE OVEN POSITIONED OVER THE RANGE OR COOK TOP

(76) Inventor: John Tsakiris, Fair Haven, NJ (US)

( * ) Notice: Subject to any disclaimer, the term of this patent is extended or adjusted under 35 U.S.C. 154(b) by 0 days.

(21) Appl. No.: 13/136,099

(22) Filed: Jul. 25, 2011

(65) Prior Publication Data

US 2011/0315136 A1 Dec. 29, 2011

Related U.S. Application Data

(62) Division of application No. 12/589,086, filed on Oct. 19, 2009, now Pat. No. 8,066,000.

(60) Provisional application No. 61/207,585, filed on Feb. 17, 2009.

(51) Int. Cl.
*F24C 15/20* (2006.01)

(52) U.S. Cl. ..... 126/299 R; 126/300; 126/299 D; 126/299 F; 219/757; 248/201; 248/317; 248/48.1; 248/48.2; 312/29

(58) Field of Classification Search ..... 126/299 R, 126/299 D, 299 F, 300; 248/201, 317, 48.1, 248/48.2; 219/757
See application file for complete search history.

(56) References Cited

U.S. PATENT DOCUMENTS 3,031,946 A * 5/1962 Watt et al. ..... 126/299 R
3,125,869 A * 3/1964 Winton ..... 62/317
3,249,037 A * 5/1966 Stalker ..... 126/299 E
3,356,008 A * 12/1967 Simpson et al. ..... 126/299 D
3,859,901 A * 1/1975 White ..... 126/299 R
4,200,087 A * 4/1980 Welsh ..... 126/299 R
4,313,043 A * 1/1982 White et al. ..... 219/757
4,327,274 A * 4/1982 White et al. ..... 219/757
4,580,853 A * 4/1986 Hitzeroth et al. ..... 312/245
4,628,185 A * 12/1986 Norwood et al. ..... 219/386
4,666,113 A * 5/1987 Itoh et al. ..... 248/201
4,788,964 A * 12/1988 Dorsey et al. ..... 126/299 R
5,388,793 A * 2/1995 Kosten et al. ..... 248/201
5,613,725 A * 3/1997 Lozano ..... 296/97.6
6,214,074 B1 * 4/2001 Silviera et al. ..... 55/385.4
6,299,267 B1 * 10/2001 Butters ..... 312/246
6,341,754 B1 * 1/2002 Melito et al. ..... 248/201
6,444,954 B1 * 9/2002 Blankenship ..... 219/391
6,622,717 B1 * 9/2003 Kim ..... 126/299 D
6,686,576 B1 * 2/2004 Yang ..... 219/757
6,717,123 B1 * 4/2004 Kim ..... 219/757
6,720,543 B2 * 4/2004 Yang ..... 219/757
6,992,273 B2 * 1/2006 Yim et al. ..... 219/757
2004/0016754 A1 * 1/2004 Yang ..... 219/757
2004/0050844 A1 * 3/2004 Yang ..... 219/757
2004/0206348 A1 * 10/2004 Bourassa et al. ..... 126/299 R
2005/0092745 A1 * 5/2005 Yim et al. ..... 219/757
2006/0231553 A1 * 10/2006 Gerami ..... 219/757
2008/0217329 A1 * 9/2008 Braunisch et al. ..... 219/757
2008/0264933 A1 * 10/2008 Jeong ..... 219/679

* cited by examiner

*Primary Examiner* — Kenneth Rinehart
*Assistant Examiner* — Jorge Pereiro
(74) *Attorney, Agent, or Firm* — Clifford G. Frayne

(57) ABSTRACT

An extendable hood and mounting bracket for mounting on the underside of a microwave oven which is positioned above a cook top, the extendable hood being frictionally engaged in the bracket and selectively removable or slidably retracted when not in use, the extendable hood extending over the front burners of the cook top and capturing and directing any fumes, smoke, or odors generated from cooking on the front burners to the fan and filter unit mounted on the underside of the microwave oven.

4 Claims, 6 Drawing Sheets

40
42
46
48
50
52
54
56
58
60
62
80
82
84
86
90
91

EXTENDABLE HOOD FOR MICROWAVE OVEN POSITIONED OVER THE RANGE OR COOK TOP

RELATED APPLICATIONS

This application is a divisional application of application Ser. No. 12/589,086, filed Oct. 19, 2009 now U.S. Pat. No. 8,066,000, which application claims the benefit of provisional application Ser. No. 61/207,585, filed Feb. 17, 2009.

BACKGROUND OF THE INVENTION

1. Field of the Invention

The present invention relates to microwaves with built-in exhaust systems on the underside, and their installation above a cook top having a plurality of heating elements, ranges or burner tops, and more particularly to a removable hood extension securable to the underside of the microwave which captures fumes, smokes and other gases generated from cooking on the front burners of the cook top, and directs such captured fumes, smoke and odors to the fan and filter, which are incorporated on the underside of the microwave oven.

2. Description of the Prior Art

Conventional ovens be they electric or gas, have a plurality of electric or gas burners on their upper surface. This upper surface is referred to as the cook top. In some instances the cook top is installed in a countertop independent of an oven, the oven being located in another portion of the cabinetry. The cook top is normally installed with an overhanging hood and fan assembly in order to capture fumes, smoke, and the like, generated from cooking on the burners located on the cook top. Depending on the orientation within the kitchen and its relationship to an inner wall or an outer wall, the hood assembly might have a filter and fan which capture and direct the fumes and smoke or the like out of an aperture in the outer wall of the building to the ambient atmosphere. More commonly the cook top abuts an internal wall and the hood could be incorporated with its own filters and recirculating exhaust fan for capturing the smoke and fumes, the internal filters being changed intermittently by the homeowner. In either instance, the hood assembly normally extends outwardly so as to be in a position to capture the smoke and/or fumes from not only the rear, but the front burners of the conventional cook top.

The advent and popularity of microwave technology has resulted in microwaves being designed to fit on the wall in the cabinet gap between the cabinets and over the conventional oven and associated cook top or a stand alone cook top. Since space is limited, the conventional hood and fan unit has been eliminated, but microwave oven manufacturers having incorporated a fan and filter mechanism on the underside of the microwave oven unit have not provided any hood structure. This type of microwave oven is referred to in the trade as "microwave over the range". Hereafter, any reference herein to a microwave or microwave oven will be understood to refer to a "microwave over the range".

This microwave oven unit only extends approximately three inches beyond the front face of the cabinets, and therefore the fan and filter assembly does not extend over the front burners of conventional cook top, as did the hood and fan unit of the prior art. As a result, fumes, smoke, and possibly grease, generated from cooking on the front burners is free to extend upwardly and settle on the front face of the microwave oven and any cabinetry above the microwave, as well as any cabinetry immediately abutting the microwave oven on either side. Therefore, there has been a need for a removable hood assembly which can be easily attached and removed from a microwave oven, which hood assembly provides an extension over the front burners of the cook top and will capture and direct the fumes, smoke, etc., generated while cooking on the front burners to the fan and filter mechanism on the underside of the microwave oven.

OBJECTS OF THE INVENTION

An object of the present invention is to provide for a novel extendable hood which is quickly and easily attached and removed from the underside of a microwave oven mounted above a cook top so as to capture and direct fumes and smoke from the cooking process on the front burners of the cook top to the fan and filter elements on the underside of the microwave oven.

A still further object of the present invention is to provide for a novel extendable hood for mounting on the underside of a microwave oven which is positioned above a cook top which allows the home owner to snap fit the extendable hood into a bracket attached to the underside of the microwave oven and to position such extendable hood without the need for any other fastening means.

A still further object of present invention is to provide for a novel extendable hood for attachment on the underside of a microwave oven positioned above a cook top wherein the extendable hood when not in use, is foldable for storage.

A still further object of the present invention is to provide for a novel extendable hood for attachment to the underside of a microwave oven positioned above a cook top in which the mounting bracket for the extendable hood and the extendable hood are cooperative so as to allow the extendable hood to retract under the microwave when not in use.

SUMMARY OF THE INVENTION

An extendable hood and mounting bracket for mounting on the underside of a microwave oven which is positioned above a cook top, the extendable hood being frictionally engaged in the bracket and selectively removable or slidably retracted when not in use, the extendable hood extending over the front burners of the cook top and capturing and directing any fumes, smoke, or odors generated from cooking on the front burners to the fan and filter unit mounted on the underside of the microwave oven.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
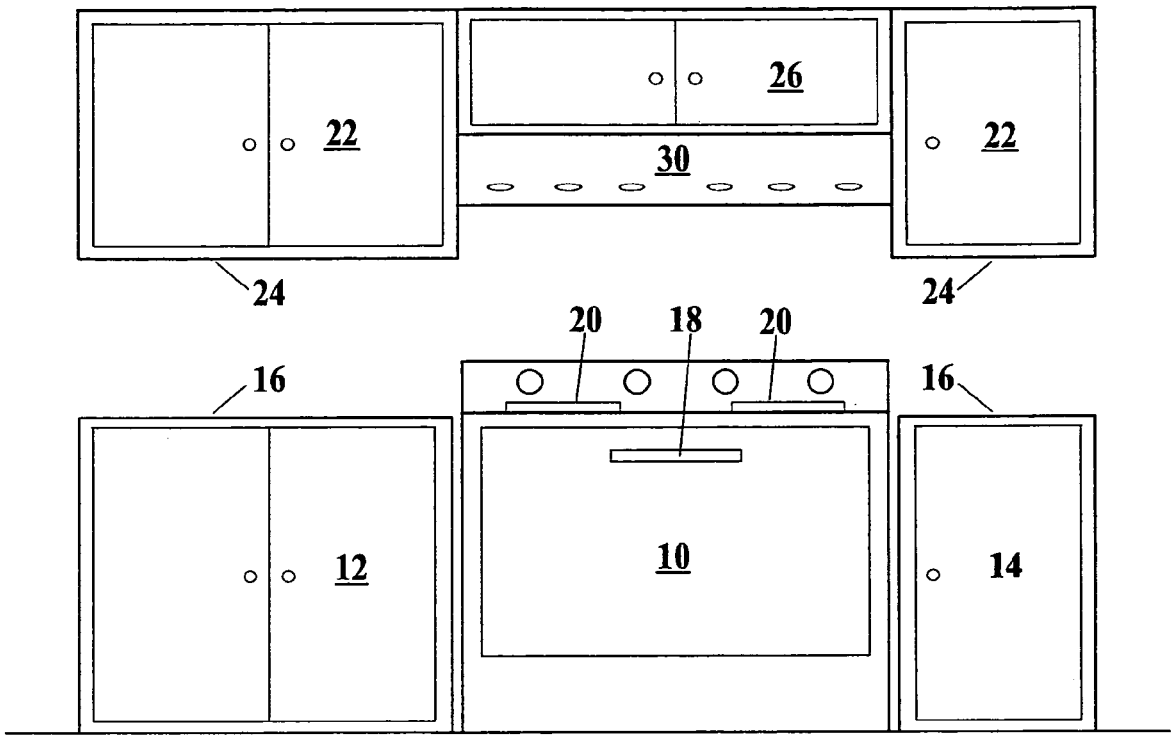
FIG. 1 is a front view of a conventional stove and hood and fan unit of the prior art.
Figure 2:
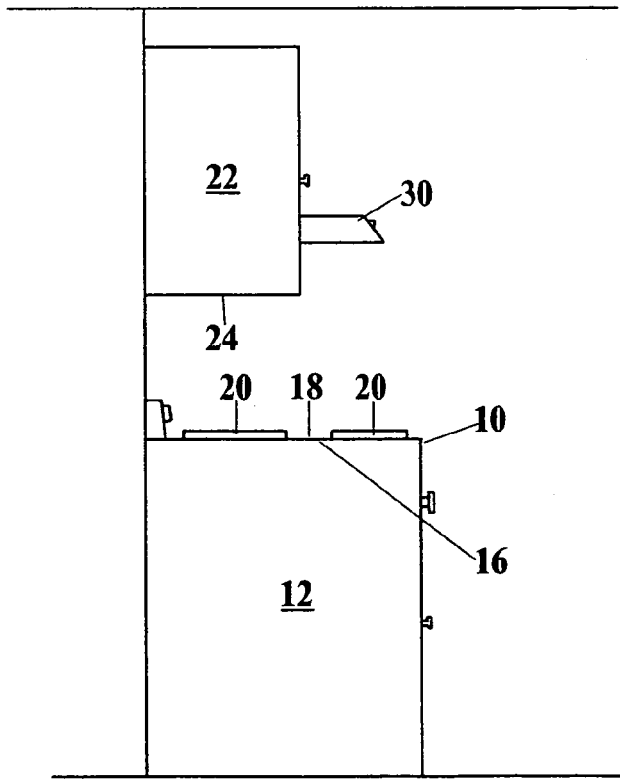
FIG. 2 is a side view of the conventional stove and hood and fan unit of the prior art.

FIGS. 1 and 2 are a front view and a side view of a conventional stove with a hood and fan unit installation of the prior art. In the arrangement depicted in FIGS. 1 and 2, a conventional stove 10 would be positioned between floor cabinets 12 and 14 which would have countertops 16 which would define a horizontal plane which would be substantially coplanar with the cook top 18 of conventional stove 10. Cook top 18 of conventional stove 10 would be fitted with a plurality of heating elements 20 be they electric or gas. It should be noted that in some installations a cook top 18 is installed independent of an oven. Applicant's hood would nevertheless have application.

Positioned above conventional stove 10 and floor cabinets 12 and 14 and countertop 16 would be a series of upper cabinets which define a space between countertops 16 and the lower wall 24 of upper cabinets 22 so as to allow access to countertop 16 surfaces. The area over the top of the conventional stove 10 is typically spanned by a cabinet 26 having a relatively short height compared to those which abut it on either side. This relatively short height accommodates a combination hood and fan and filter assembly 30 which is secured to the wall and/or the underside of cabinet 26 and extends outwardly a distance equal to the depth of the conventional stove and its cook top. The hood is fabricated from sheet metal normally and includes a fan and filter assembly and possibly an illuminating light. The activation of the fan captures smoke, odors, steam of the like from the pots or pans being used on the upper burners of the cook top of the conventional stove and directs the odors, smoke, steam and the like to the filters where they are captured. The filters are removable and selectively replaceable by the homeowner.

With the exception of custom kitchens, the heights, depths and spacing of kitchen cabinets and kitchen appliances has become somewhat standardized in the trade. These dimensions normally are as follows, give or take slight tolerances. The height of the floor cabinets from floor to countertop is 35 inches. The depth of the floor cabinets is 24 inches. The counter top may extend beyond this length. The distance from the countertop to the bottom of the upper cabinets is 18 inches. The width of a conventional stove is approximately 30 inches and its depth is slightly greater than the depth of the floor cabinets. The depth of the upper cabinets are 12 inches. The height of the upper cabinet which bridges across the stove recess is normally 15 inches, and the height of the conventional hood with fan and filters is approximately six inches at its greatest height.

With the advent of microwave ovens, a popular location in which to install the microwave is over the cook top. This necessitates at the minimum, the removal of the former hood and combination filter, light and fan. Depending upon the size of the microwave, it also may be necessary to downsize the upper cabinet 26 which spans over the stove. This cabinet is normally 15 inches in height but may have to be replaced with a cabinet of 12 inches in height in order to accommodate the installed microwave and yet provide sufficient space between the underside of the microwave and the cook top and burner portion of the stove. Still further, microwaves for this type of installation have become standardized to an extent and extend only approximately between 3 to 4 inches beyond the front face of the upper cabinets. Microwaves for this type of installation are also equipped with a fan and filter arrangement on their underside. However the fact that the microwave only extends 3 inches beyond the front face of the upper cabinets, whereas the former hood and filter and fan combination extended over the entire cook top of the conventional stove creates the problem of capturing and directing odors, steam, and/or smoke or the like generated by cooking on these front burners to the filters on the underside of the microwave.

Figures 3, 4, 5, 6:
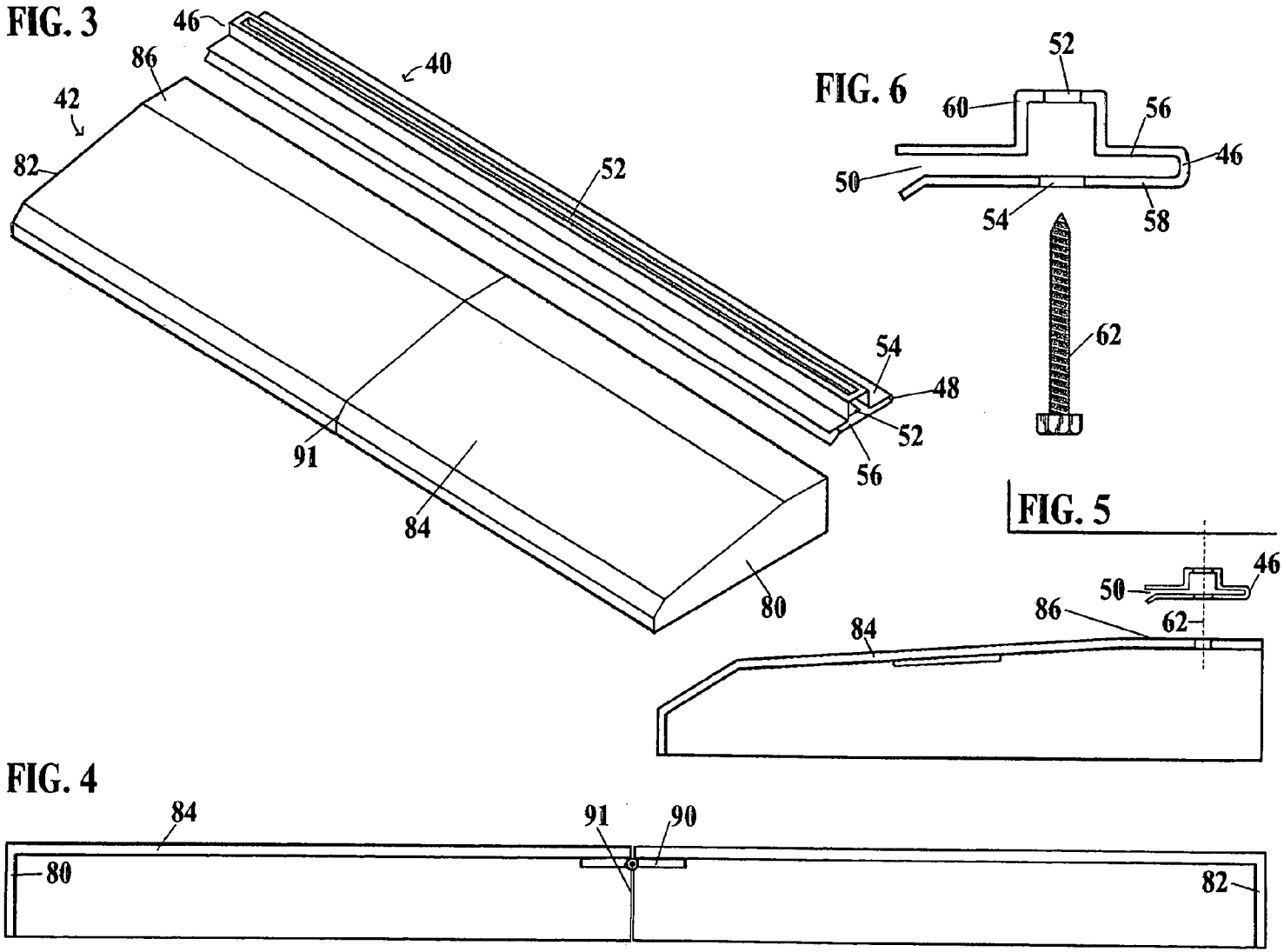
FIG. 3 is a perspective exploded view of an extendable hood and bracket assembly of the present invention for attachment to the underside of a microwave oven.
FIG. 4 is a rear view of the extendable hood of the present invention.
FIG. 5 is an exploded side cutaway view of the bracket and extendable hood in relationship to the underside of a microwave oven.
FIG. 6 is a side view of the bracket assembly.

FIG. 3 is a perspective exploded view of a bracket 40 and a first embodiment of an extendable hood 42 utilized in the present invention for frictionally securing the extendable hood 42 to the underside of a microwave. FIG. 4 is a rear view of the extendable hood 42. FIG. 5 is an exploded side view of the bracket 40 and extendable hood 42 in relationship to a microwave oven 44. FIG. 6 is a close up side view of the bracket 40.

Bracket 40 would be fabricated from a planar metal blank being approximately 29 inches in length and ranging from 2 to 3 inches in width, and having a thickness of approximately $1/16^{th}$ to $1/8^{th}$ of an inch. The planar metal blank would be stamped with a longitudinal fold line 46 allowing bracket 40 to be folded upon itself to form a longitudinal slot receptacle 50 as illustrated in FIGS. 5 and 6.

Prior to folding upon itself, bracket 40 is stamped with a plurality of aligned slotted apertures 52 and 54 on what would become after folding, upper surface 56 and lower surface 58. FIG. 3 illustrates a continuous slot, however, the slot could be interrupted with cross members if so desired in order to increase the structural integrity of the bracket. The upper surface 56 of the bracket 40 is also stamped so as to form an inverted U-channel 60 along which the slotted aperture 52 of upper surface 56 runs.

When folded, the upper surface 56 of the bracket, and in particular, the upper ridge 60, would abut the underside of a microwave oven 44, the aligned slotted apertures 52 and 54 allow for the bracket to align with the actual underside assembly fasteners of the microwave oven 44. Several of the underside assembly fasteners 62 of the microwave oven are removed, the bracket 40 is aligned with the apertures of these removed fasteners, and the fasteners 62 are then reinstalled by inserting them through the aperture 54 in the lower face 58 of bracket 40 and through the slotted aperture 52 in the ridge member 60 of the upper face member 56. The ridge member 60 allows for the head of the fastener to be segregated from slotted aperture 50 so that the extendable hood 42 can be received therein. The aperture 54 in lower face 58 is wide enough to allow the head of the threaded fastener 62 to pass through, where as the aperture 52 on the upper ridge member 60 is narrow and allows only the threaded portion of the fastener to pass through into the original securing bores on the underside of the microwave oven 44. It should also be noted that when bracket 40 is stamped and folded, longitudinal slotted opening 50 is formed with a slight flare 64 allowing ease of insertion of the extendable hood 42.

The extendable hood 42 is fabricated from sheet metal or other suitable material. It would measure approximately 29 inches in width, 6½ inches in depth, and 1 inches at its greatest height. It will be comprised of two end panels 80 and an integral front and top panel 84, which may be of unitary construction or for this particular bracket, it may be hinged as illustrated. The top panel 84 could be slightly sloped from rear to front, or flat. If sloped, a portion of the rear 86 of the top panel 84 would necessarily be flat 88 in order to be slidably received within the longitudinal slot 50 of bracket 40. The flat rear portion 88 of the top panel 84 cooperates with bracket 40 installed in the underside of the microwave oven 44 to slidably receive that flat rear portion 88 of the top panel 84 within the longitudinal slot 50 across the entire distance of bracket 40 thereby positioning and securing the extendable hood 42 forwardly and outwardly from the microwave oven 44 a distance sufficient to cover the front burners of the cook top positioned below. The extendable hood 42 would serve to capture and direct any smoke, odor or steam coming from a pot or pan being utilized on the front burners of the cook top to the fan and filter arrangement installed on the underside of the microwave.

FIG. 4 illustrates extendable hood 42 which incorporates a hinge member 90 on the inner surface of its top panel 84. The hinge member 90 would not extend completely to the rear edge of the top panel 84 so as not to interfere with the slidable reception of the extendable hood 42 into longitudinal slot 50. The hingeable arrangement as illustrated would allow the outer surfaces of top panel 84 divided by hinge line 91 to be folded into juxtaposition with each other when the extendable panel 42 was removed from the longitudinal slot 50 and provides ease of storage. A pin and slot hinge type would also allow the disassembly of the extension hood into two pieces for storage.

Figure 7:
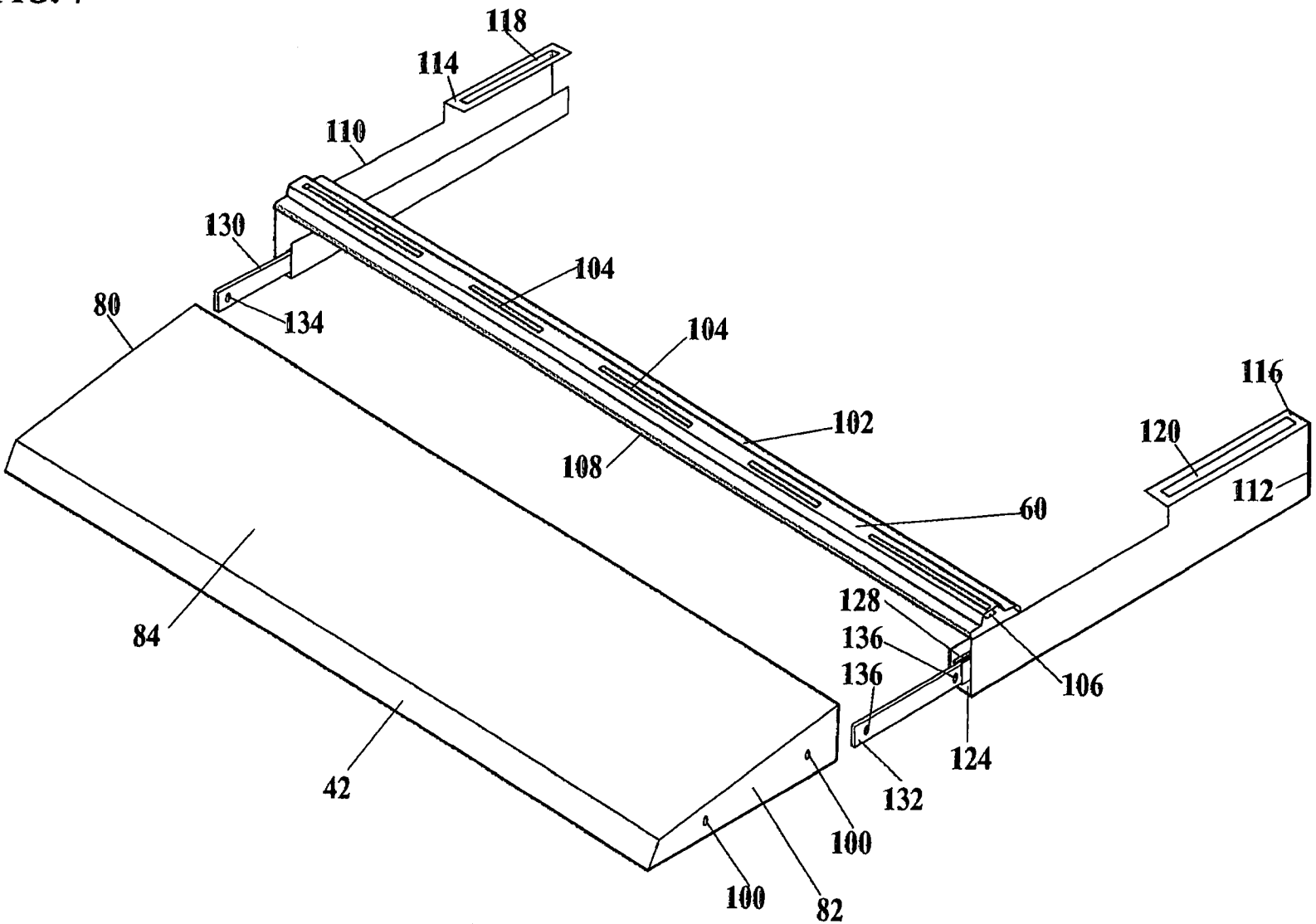
FIG. 7 is a perspective exploded view of an extendable hood utilizing a drawer slide bracket for the attachment to underside of a microwave.

FIG. 7 is a perspective exploded view of a second embodiment of an extendable hood 42A of the present invention. In the embodiment illustrated in FIG. 7, the extendable hood 42A is identical to the extendable hood illustrated in FIGS. 3 and 4 with the exception that the extendable hood 42A of FIG. 7 is not hinged and does not require a planar rear portion of top panel 84. The extendable hood 42A of FIG. 7 is designed to be retractable underneath the microwave oven 44. To accomplish this, the end panels 80 and 82 would have a plurality of apertures 100 formed therein. The preferred bracket would incorporate a transverse mounting bracket 102 similar to that of the upper surface 56 of the bracket 40 of FIGS. 3 and 6, however, there would be no lower surface 58 and no longitudinal slot 50. The inverted U-shaped channel upstanding ridge member 60 would have a plurality of slotted apertures 104 in alignment with slotted apertures 106 on the lower surface 108 of mounting bracket 102 which would span the front of the microwave oven 44 and be secured to the underside thereof. At each end of mounting bracket 102, there would be parallel lateral bracket members 110 and 112 which would have a fold over top surface 114 and 116 proximate their rear terminus and having a slotted aperture 118 and 120 there through. Formed on the inner walls 122 and 124 of lateral bracket members 110 and 112 would be a slotted slide receptacle 126 and 128 for the receipt of a slide arm 130 and 132 which would have apertures 134 and 136 in spaced apart relationship thereon for alignment with the apertures 100 on the side panels 80 and 82 of the extendable hood 42A for securing extendable hood 42A to the slide arms with suitable fasteners.

In this configuration, fasteners utilized to secure the bottom wall of the microwave could be removed and utilized to install the bracket members 102, 110, and 112 to the underside of the microwave oven 44. The extendable hood 42A would then be secured to the slide arms 130 and 132 by means of fasteners. The fasteners attaching the extendable hood 42A to the slide arms 130 and 132 would be countersunk so as to not interfere with the slidability of the slide arms within the slide receptacles 126 and 128. In this configuration, when not in use, the extendable hood 42A would be stored beneath the microwave and when required, would be pulled forward to extend over the cook top, and more particularly the front burners or heating elements of the cook top.

Figure 8:
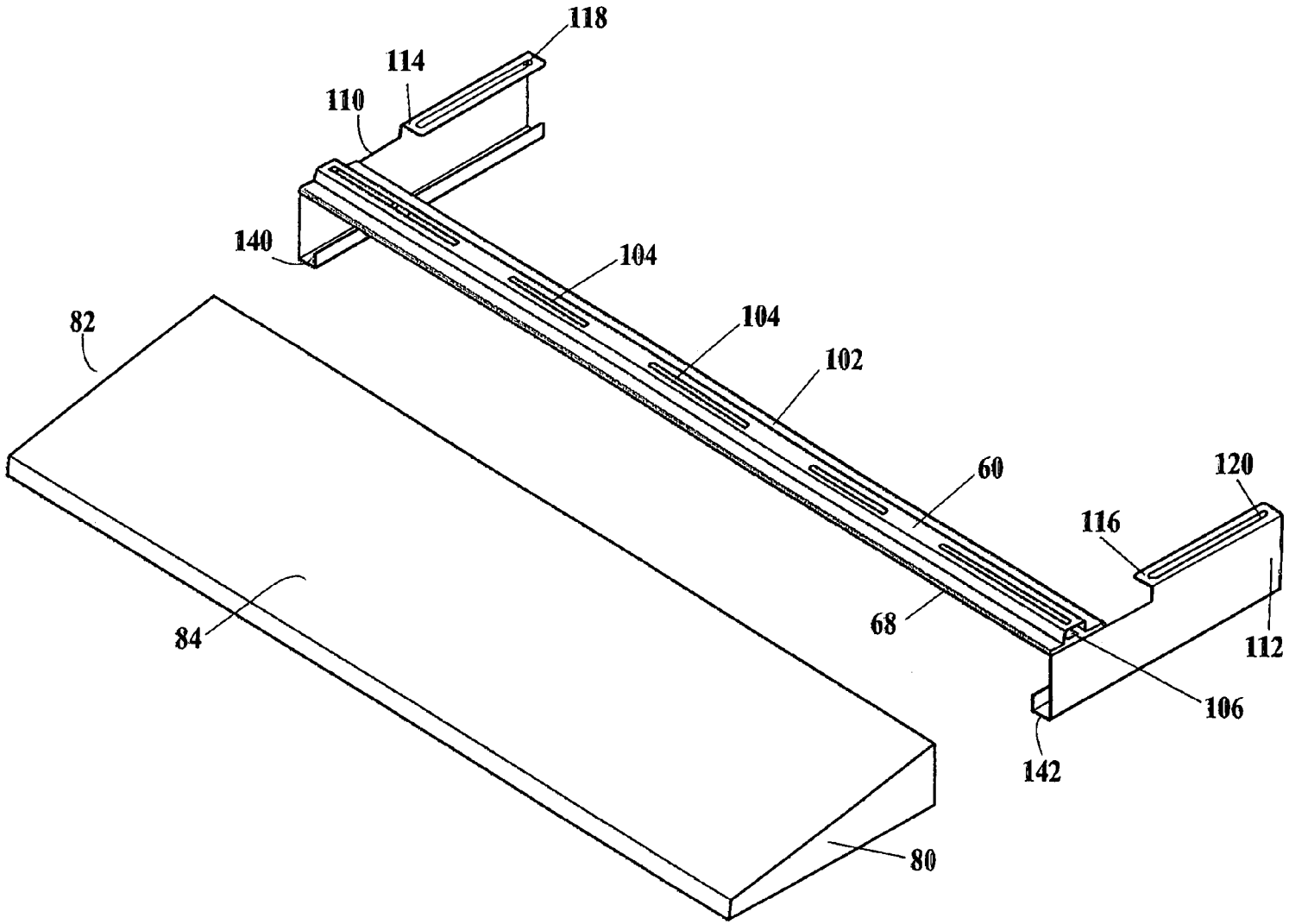
FIG. 8 is a perspective view of an extendable hood with a slide bracket for retracting the extendable hood on the slide bracket under the microwave oven.

FIG. 8 is a perspective view of a third embodiment of the extendable hood. In this configuration, the extendable hood 42A is a retractable extendable hood. It is not hinged, and it does not require any apertures in side panels 80 and 82. The front mounting bracket 102 is identical to that of the front mounting bracket illustrated in FIG. 7, and the lateral side brackets 110 and 112 are similar with respect to top surface 114 and 116 and associated slot apertures 118 and 120. The additional feature is that their lower surface is folded to form U-shaped slide channels 140 and 142. These U-shaped slide channels engage the lower edges of side panels 80 and 82 which allows for the retractability of the extendable hood 42A beneath the microwave oven 44 when not in use, and to extend outwardly from beneath the microwave oven 44 when the front burners of the cook top are in use.

Figure 9:
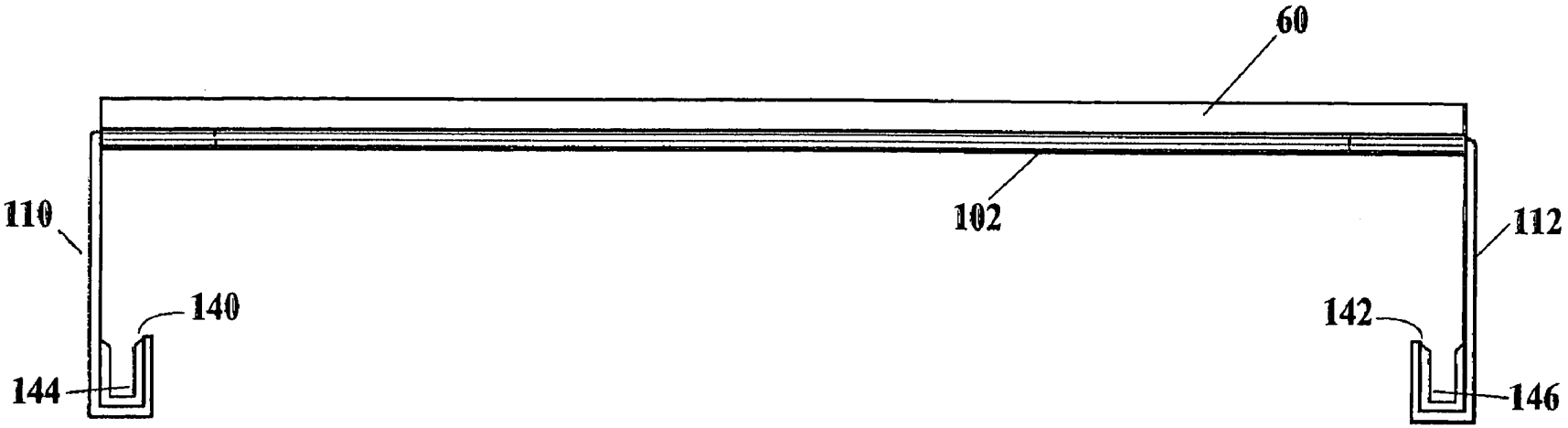
FIG. 9 is a rear view of the slide bracket of FIG. 8, which incorporates extruded slide channel guides for quietness and ease of operation.

FIG. 9 is a rear view of the bracket member of FIG. 8 which would further include polymer slide channel guides 144 and 146 within the U-shaped slide channels 140 and 142 of the lateral brackets 110 and 112. This would improve the ease of retractability of the extendable hood 42A and also reduce the audible noise of the movement of the extendable hood 42A in the slide channels.

Figure 10:
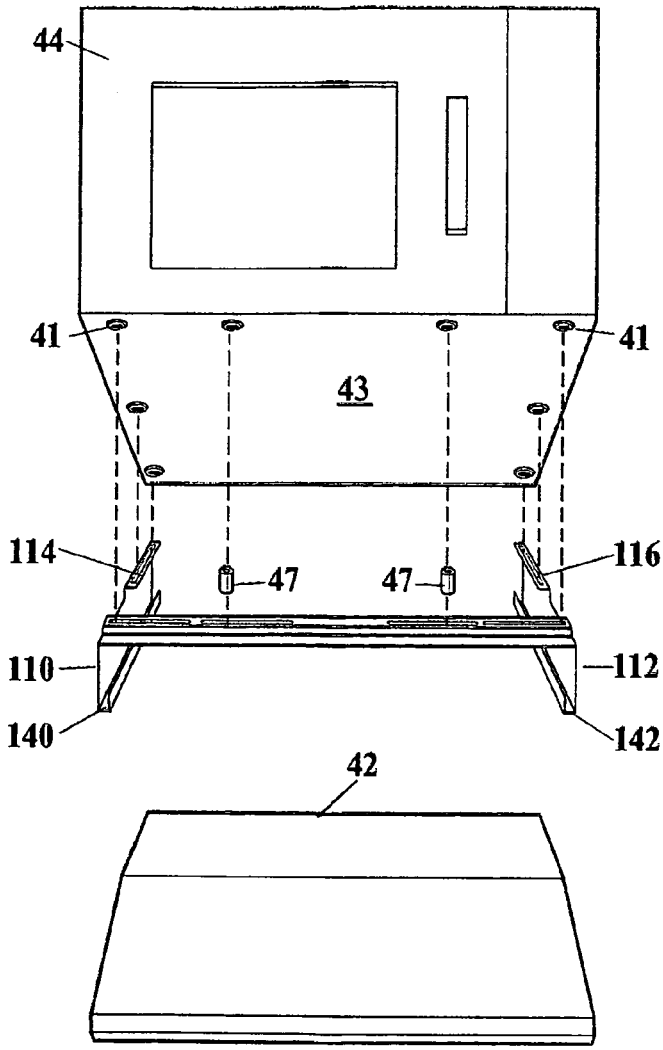
FIG. 10 is a front perspective exploded view of the extendable hood and bracket assemblies of FIGS. 7, 8, and 9 illustrating the manner of assembly.

FIG. 10 is a perspective exploded view of the attachment of the brackets of FIGS. 7, 8, and 9 to the underside of the microwave oven 44. The underside of the microwave oven 44 has a plurality of threaded fasteners 41 holding the bottom surface 43 to the microwave oven 44. The brackets are designed with the slot apertures positioned to align with a plurality of the fasteners utilized on the underside of the microwave oven 44. Thus these fasteners can be removed and utilized to install the bracket to the underside of the microwave oven. If there were insufficient fasteners in alignment with the slots on the bracket, additional apertures could be drilled in the underside of the microwave oven in order to insure adequate fastener support for the bracket. Once the installation of the bracket is accomplished, the extendable hood could be slidably received within the bracket as illustrated in FIGS. 8 and 9 or attached to the extendable arms of the bracket as illustrated in FIG. 7. Due to variations in the topography of the underside 43 of a microwave oven 44, it will be recognized that spacers 47 associated with each fastener and positioned on the fastener between the bracket and the underside 43 of the microwave oven may be used to level and provide appropriate clearance for retraction and extension of the hood.

Figure 11:
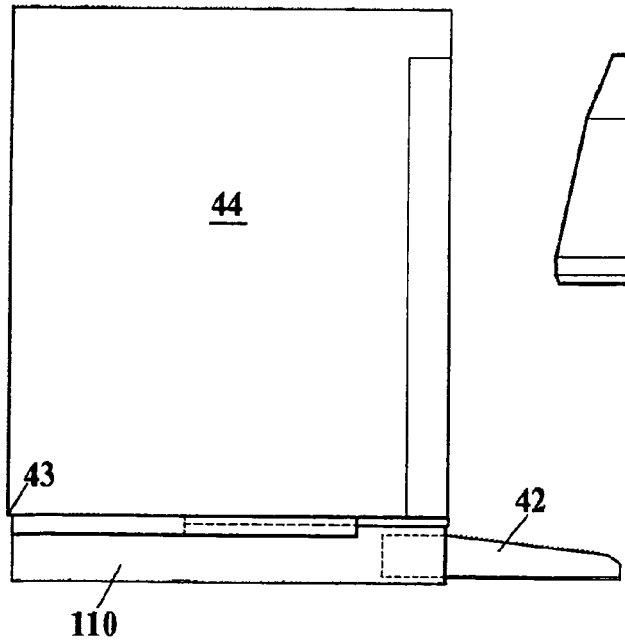
FIG. 11 is a side view of a microwave oven with the bracket of FIG. 7, 8, or 9 illustrated with the extendable hood in an extended position.

FIG. 11 is a side view of the microwave oven with the bracket attached illustrating the extendable hood 42A in an extended position so as to extend over the front cooking elements of a cook top.

Figure 12:
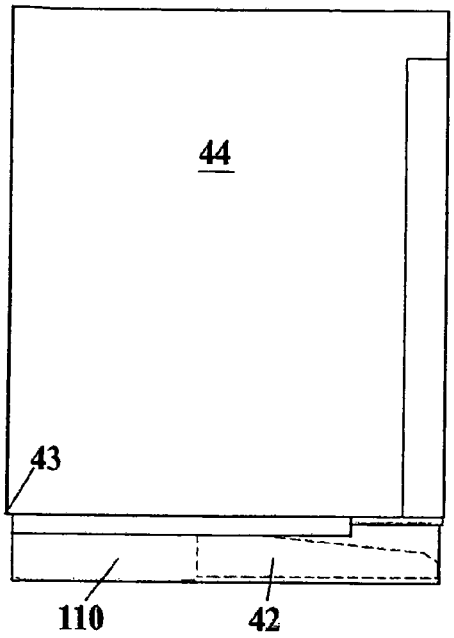
FIG. 12 is a side cutaway view of FIG. 11 illustrating the extendable hood in a retracted position within the bracket.

FIG. 12 is a partial cross-sectional view of the microwave oven and bracket illustrating the extendable hood 42A in a retracted position when not in use.

It should be noted that in all of the embodiments illustrated, the positioning of the various embodiments of the bracket and the positioning of the retractable extended hood when not in use, does not interfere with the lights and/or exhaust fans associated with the underside of the microwave oven 44.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An extendable visor hood assembly for microwaves mounted above a cook top, the extendable visor hood comprising:

a bracket mounted to the underside of a microwave, said bracket comprises a unitary cross bracket having a lower member and an upper member folded upon each other to form a closed longitudinal edge and an open slotted longitudinal edge, said upper member formed with an upstanding ridge, said ridge having an aperture there through in alignment with an aperture through said lower member for the complete passage of a threaded fastener through said aperture in said lower member, said threaded portion of said threaded fastener passing through said aperture in said ridge member, said head of said threaded fastener when secured, positioned within a cavity formed by said ridge, said bracket spanning the front underside width of said microwave;

an extendable visor hood mounted to said bracket and extending outwardly from said bracket above front cooking burners on said cook top to direct odors and steam to a fan and filter contained and incorporated within the microwave.

2. The extendable visor hood assembly in accordance with claim 1 wherein extendable visor hood comprises two end panels, and a unitary front and top panel, said unitary front and top panel dimensioned to span the width of a microwave oven, said unitary front and top panel having a planar flat surface along a rear edge for engagement within said longitudinal slotted edge of and said bracket.

3. The extendable visor hood assembly in accordance with claim 1, wherein said extendable visor hood is formed of two end panels, and a bifurcated front and top panel, said bifurcated front and top panels secured by a hinge member on an underside of said front and top panels, said bifurcated front and top panels having a planar flat surface at it rearmost edge, for engagement in said slotted aperture of said bracket, said extendable visor hood being foldable along said bifurcation and said hinge when removed from said slotted aperture, for ease of storage.

4. An extendable visor hood assembly for microwaves mounted above a cook top, the extendable visor hood comprising:

a bracket mounted to the underside of a microwave; an extendable visor hood mounted to said bracket and extending outwardly from said bracket above front cooking burners on said cook top to direct odors and steam to a fan and filter contained and incorporated within the microwave;

wherein said bracket comprises a cross bracket having an inverted U-shape in cross section having slotted apertures there through for receipt of threaded fasteners and having opposing longitudinal flanges and having two side panel bracket members, secured to the longitudinal termini of said cross bracket, said side panel bracket members each defined by a planar upper surface having a horizontal slotted aperture there through, said side panel bracket members having a slidable guide recess formed on an inner surface thereof, said slided guide surface for receipt of a slidable retractable arms, having a plurality of apertures at an extended end, said apertures cooperable with apertures formed in side panels of said extendable visor hood for slidably securing said extendable visor hood to an underside of said microwave oven and permitting the slidable retraction and extension of said extendable visor hood beneath said microwave oven.

* * * * *